US007261234B1

(12) United States Patent
Mahajan

(10) Patent No.: US 7,261,234 B1
(45) Date of Patent: Aug. 28, 2007

(54) STOP DEVICE FOR A MAILBOX HOOK

(76) Inventor: Shekhar G. Mahajan, 6439 Lake Mathias Dr., New Albany, OH (US) 43054

( * ) Notice: Subject to any disclaimer, the term of this patent is extended or adjusted under 35 U.S.C. 154(b) by 0 days.

(21) Appl. No.: 11/551,237

(22) Filed: Oct. 19, 2006

(51) Int. Cl.
*A47G 29/12* (2006.01)

(52) U.S. Cl. ..... 232/38; 232/17; 232/29; 40/606.06

(58) Field of Classification Search ..... 232/38, 232/17, 29, 33, 45, 1 C; 40/606.06; D99/29–32; 248/339
See application file for complete search history.

(56) References Cited

U.S. PATENT DOCUMENTS

| | | | | |
|---|---|---|---|---|
| 1,071,082 | A | 8/1913 | Peck | |
| 1,364,126 | A * | 1/1921 | Martel | 232/45 |
| 1,807,611 | A * | 6/1931 | Zapart | 232/45 |
| 2,609,787 | A * | 9/1952 | Lawson | 232/35 |
| 2,707,075 | A * | 4/1955 | Duzer | 232/35 |
| 2,808,982 | A * | 10/1957 | Armstrong | 232/35 |
| 3,263,352 | A * | 8/1966 | Fitzpatrick | 40/661.11 |
| 3,515,337 | A | 6/1970 | Bornus | |
| 3,556,395 | A | 1/1971 | Herman | |
| 3,762,632 | A | 10/1973 | Voegeli | |
| 3,901,433 | A | 8/1975 | Jacobs et al. | |
| 4,146,171 | A | 3/1979 | Hodge | |
| 4,201,299 | A | 5/1980 | Bumgarner et al. | |
| 5,366,147 | A | 11/1994 | Morgan et al. | |
| 5,437,409 | A * | 8/1995 | Coushaine | 232/39 |
| 5,624,071 | A * | 4/1997 | Sosan | 232/17 |
| 6,513,284 | B1 * | 2/2003 | Sandlin | 47/66.6 |
| 6,869,054 | B1 | 3/2005 | Pearsall | |
| 7,025,250 | B2 * | 4/2006 | Wolfe, Jr. | 232/35 |

FOREIGN PATENT DOCUMENTS

| | | |
|---|---|---|
| FR | 2858305 | 2/2005 |

* cited by examiner

*Primary Examiner*—William L. Miller
(74) *Attorney, Agent, or Firm*—Law Office of Steven B. Leavitt, L.L.P.

(57) ABSTRACT

The present invention is directed to a stop device for a mailbox. The stop device includes a body having a front surface, a back surface and an orifice for hanging the device from a mailbox. The stop device is able to restrict the movement of items hanging from a mailbox when the device is suspended from the mailbox.

18 Claims, 2 Drawing Sheets

STOP DEVICE FOR A MAILBOX HOOK

BACKGROUND OF THE INVENTION

1. Technical Field

This invention relates to a stop device, and more particularly, to a stop device for hanging material on a mailbox.

2. Description of Related Art

A large number of mailboxes include a mailbox hook or similar structure located on the mailbox for hanging various items. For example, postal carriers, solicitors, and others often use mailbox hooks to hang bags containing advertising material or newspapers. Unfortunately, as the bags or other items hang from the mailbox hook, they are easily moved about due to wind and other weather conditions. As a result, the items hanging from the mailbox hook often become twisted, tangled or fall off of the mailbox hook completely. What is needed is a device that would prevent the items hanging from a mailbox hook becoming twisted or tangled.

SUMMARY OF INVENTION

The present invention solves the above-described problem by providing a stop device for a mailbox that prevents the items hanging from a mailbox hook from becoming twisted or tangled. The stop device includes a body having a front surface, a back surface and an orifice for hanging the device from a mailbox. The stop device is able to restrict the movement of items hanging from a mailbox when the device is suspended from the mailbox.

More particularly, the body is a sheet and may be in the shape of a triangle, oval, circle, pentagon, octagon, square, or any other polygon. The device has a length and width able to prevent the items hanging from a mailbox hook from being blown around or over the mailbox hook and from becoming twisted or tangled. In one embodiment, the length at the longest point is between about 4 inches and about 24 inches, and at the longest point has a width between about 3 inches and about 24 inches. It should be noted that the length and width will depend on the type of material that will be hung from the mailbox hook and the device should be large enough to prevent material hanging from the mailbox hook from being blown to the other side of the device.

The device is made of a rigid or semi-rigid material that does not easily bend in the wind and is able to prevent the items hanging from a mailbox hook from becoming twisted or tangled. Such material includes but is not limited to plastic, metal, or some other similar material that is relatively weather resistant and can retain its shape under windy conditions.

Other features and advantages of the present invention will become apparent upon reading the following detailed description of embodiments of the invention, when taken in conjunction with the appended claims.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

Figure 1:
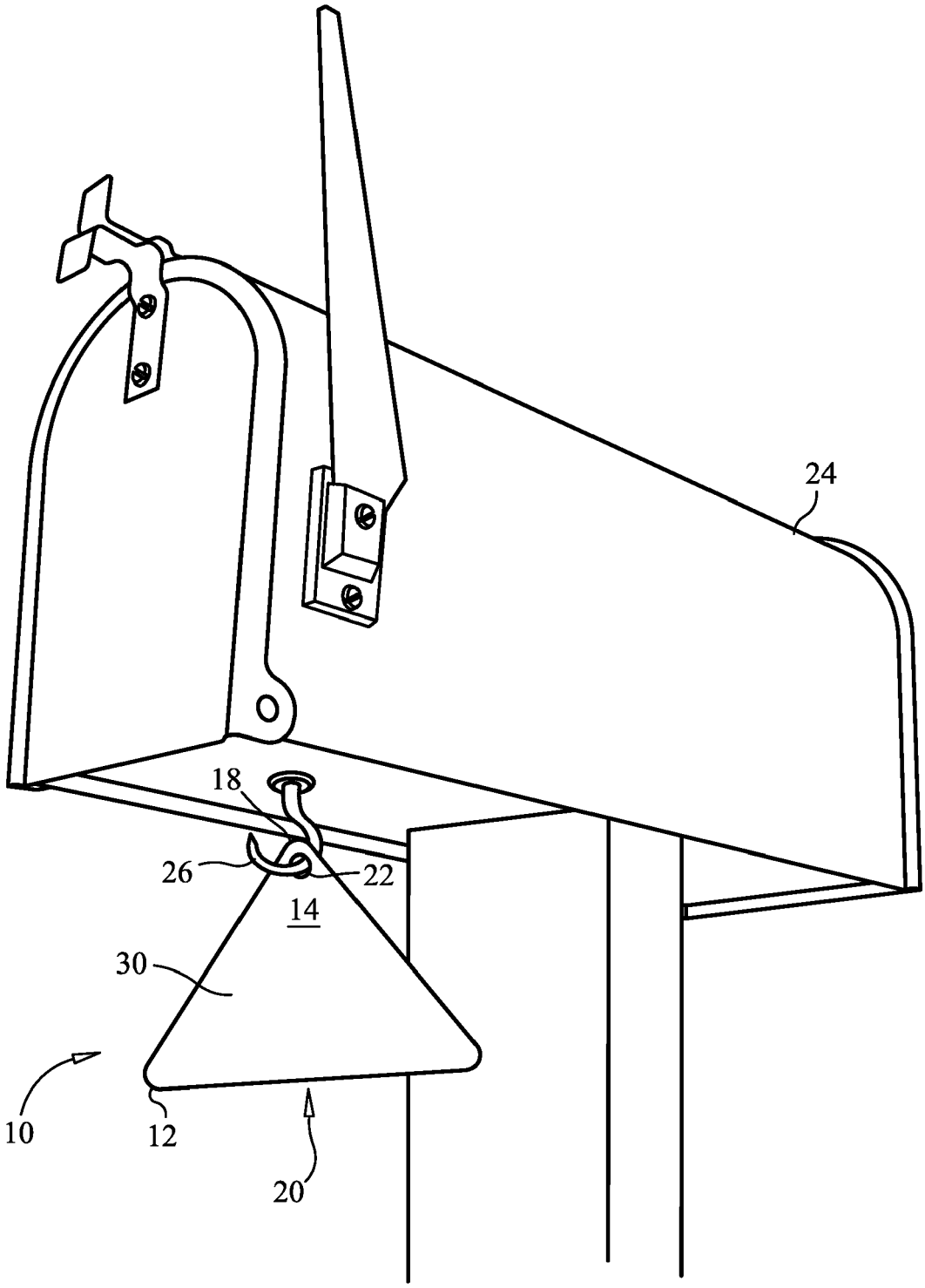
FIG. 1 is a front view of a stop device on a mailbox in accordance with an embodiment of the present invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Figure 2:
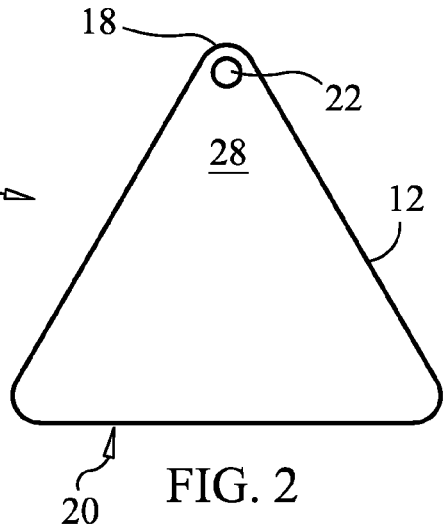
FIG. 2 is a back view of a stop device in accordance with an embodiment of the present invention.

Referring to FIG. 1, shown is stop device 10 for mailbox 24. Device 10 includes body 12 having front surface 14, back surface 28 (shown in FIG. 2), top edge 18 and bottom edge 20. Body 12 also includes orifice 22 for hanging device 10 from a mailbox 24. Preferably, orifice 22 is located proximate to top edge 18 of body 12. Orifice 22 may be any shape which allows stop device 10 to be hung from mailbox hook 26, and remain on mailbox hook 26 until removed by a user.

Body 12 of stop device 10 is preferably a sheet, and desirably has a thickness able to provide a rigid or semi-rigid support. Body 12 may be any shape, which effectively restricts the movement of an item hanging from mailbox hook 26. Suitable shapes for body 12 include, but are not limited to a triangle, oval, circle, pentagon, octagon, square, or any other polygon. Preferably, body 12 is in the shape of a triangle.

Device 10 is made of a rigid or semi-rigid material that is able to prevent the items hanging from a mailbox hook from becoming twisted or tangled. Preferably, the material does not easily bend in the wind. Such material includes but is not limited to plastic, metal, or some other similar material that is relatively weather resistant and can retain its shape under windy conditions. Preferably, the body 12 is comprised of plastic.

As shown in FIG. 1, mailbox hook 26 is typically located on the bottom of a mailbox 24. Postal carriers, solicitors, and other users use mailbox hook 26 to hang bags containing promotional material, newspapers and/or other information or material such as pamphlets, fliers, or bags containing material.

Stop device 10 is designed to restrict the movement of any items, including those identified above, while the items are hanging from mailbox 24. Stop device 10 is able to restrict the movement of one item hanging from the mailbox 24 or a plurality of items hanging from the mailbox and therefore prevent the items from becoming tangled or twisted.

Figure 3:
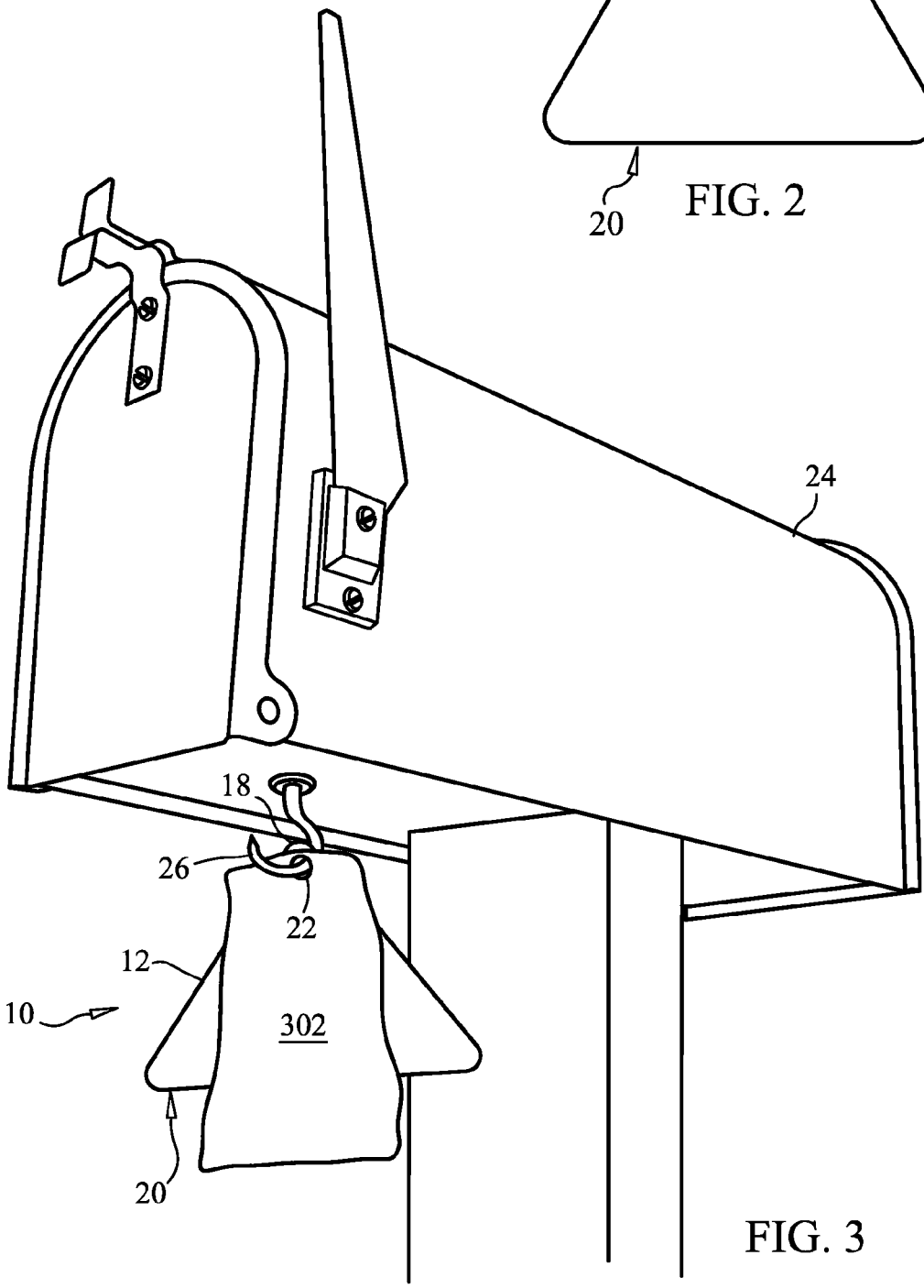
FIG. 3 is a view of the stop device in use in accordance with an embodiment of the present invention.

To use, as shown in FIG. 3, stop device 10 is placed on mailbox hook 26 or similar structure located on mailbox 24. Next, an item such as a bag 302, is placed on mailbox hook 26 in front of stop device 10. Due to the shape and position of the stop device 10, the movement of the item placed on mailbox hook 26 in front of the device is restricted. The item is unable to twist or turn on mailbox hook 26 and thus is prevented from becoming twisted or tangled. Stop device 10 is particularly effective at preventing bags hung on a mailbox hook 26 from spinning and becoming tangled.

If desired, instructional message 30 may be printed on front surface 14 and/or back surface of the device body 12. For example, the phrase "hang bags here" may be placed on device 10. Alternatively, an advertisement message, including a logo or phrase, may be located on front surface 14 and/or back surface of the device 10.

It should be understood that the foregoing relates to exemplary embodiments of the invention and that modifications may be made without departing from the spirit and scope of the invention as set forth in the following claims.

What is claimed is:

1. A stop device in combination with a mailbox, the combination comprising:

the mailbox including a hook located thereon;

the stop device including a body having a front surface, back surface, and an orifice receiving the hook such that the device hangs on the hook;

an item cooperating with the hook such that the item hangs on the hook; and whereby the device hanging on the hook restricts the movement of the item hanging on the hook by preventing the item from spinning and being tangled on the hook.

2. The combination of claim 1, wherein the body is a sheet.

3. The combination of claim 2, wherein the body is in the shape of a triangle, oval, circle, pentagon, octagon, or square.

4. The combination of claim 3, wherein the body is in the shape of a triangle.

5. The combination of claim 1, wherein the item hanging from the hook is a bag.

6. The combination of claim 1, wherein the body is comprised of plastic or metal.

7. The combination of claim 6, wherein the body is comprised of plastic.

8. The combination of claim 1, wherein the body has a top edge and a bottom edge, and the orifice is located near the top edge of the body.

9. The combination of claim 1, wherein the device has a length between about 3 inches and about 24 inches, and has a width between about 3 inches and about 24 inches.

10. The combination of claim 1, wherein the device comprises instructional words located on the front surface.

11. The combination of claim 1, wherein the device comprises an advertisement message located on the front surface.

12. The combination of claim 1, wherein the device is able to restrict the movement of a plurality of the items hanging from the hook when the device is suspended from the hook.

13. A method for preventing material from being tangled on a mailbox hook, the method comprising the steps of:

providing a mailbox having a hook;

hanging a stop device on the hook, the stop device including a body having a front surface, back surface, and an orifice for receiving the hook to hang the device on the hook;

hanging an item on the hook; and whereby the device hanging on the hook restricts the movement of the item hanging on the hook by preventing the item from spinning and being tangled on the hook.

14. The method of claim 13 wherein the body is in the shape of a triangle, oval, circle, pentagon, octagon, or square.

15. The method of claim 14 wherein the body is in the shape of a triangle.

16. The method of claim 13 wherein the body is comprised of plastic or metal.

17. The method of claim 13 wherein the body is comprised of plastic.

18. The method of claim 13 wherein the device comprises an advertisement message located on the front surface.

* * * * *